United States Patent [19]

Takahashi

[11] Patent Number: 4,813,895

[45] Date of Patent: Mar. 21, 1989

[54] FORWARD-REVERSE FOR MARINE PROPULSION DEVICE OF A WATER-JET TYPE

[75] Inventor: Hideharu Takahashi, Hamamatsu, Japan

[73] Assignee: Sanshin Kogyo Kabushiki Kaisha, Hamamatsu, Japan

[21] Appl. No.: 41,828

[22] Filed: Apr. 23, 1987

[30] Foreign Application Priority Data

May 1, 1986 [JP] Japan ..... 61-101427

[51] Int. Cl.[4] ..... B63H 11/10

[52] U.S. Cl. ..... 440/41; 440/43

[58] Field of Search ..... 440/38, 39, 40, 41, 440/42, 43, 47; 60/221, 222, 228, 230, 239

[56] References Cited

U.S. PATENT DOCUMENTS

| | | | |
|---|---|---|---|
| 3,054,375 | 9/1962 | Neely . | |
| 3,082,732 | 3/1963 | Stallman . | |
| 3,266,733 | 8/1966 | Goehler | 440/41 |
| 3,347,203 | 10/1967 | Starry | 440/41 |
| 4,176,616 | 12/1979 | Robins | 440/43 |
| 4,459,117 | 7/1984 | Jordan . | |
| 4,538,997 | 9/1985 | Haglund | 440/43 |

FOREIGN PATENT DOCUMENTS 49-94393 8/1974 Japan .

*Primary Examiner*—Sherman D. Basinger
*Assistant Examiner*—Stephen P. Avila
*Attorney, Agent, or Firm*—Ernest A. Beutler

[57] ABSTRACT

Two embodiments of improved reverse thrust shifting mechanisms for jet drives. In each embodiment, there is provided a reverse discharge bucket that has an outlet opening that can be effectively controlled for generating either reverse or neutral thrust conditions.

6 Claims, 5 Drawing Sheets

FORWARD-REVERSE FOR MARINE PROPULSION DEVICE OF A WATER-JET TYPE

BACKGROUND OF THE INVENTION

This invention relates to a forward-reverse shifting apparatus for a marine propulsion device of the water-jet type and more particularly to an improved reverse bucket arrangement for such a device.

The use of jet propulsion units in watercraft is very popular for a wide variety of reasons. With this type of unit, the watercraft is propelled in a forward direction by employing a jet nozzle from which water is expelled after being pressurized by an impeller. With this type of drive, it has been the practice to provide a reverse bucket or deflector that is swung into registry with the discharge nozzle and which redirects the discharge in a forward direction so as to achieve reverse drive of the watercraft. Such reverse buckets are normally swung into position from a retracted position below the nozzle or from a retracted position above the nozzle.

In accordance with these arrangements, it is also desirable to provide a position in which there will be no forward or reverse thrust or wherein the forward and reverse thrust balance each other to achieve a neutral operation. However, the prior art devices previously proposed have had certain disadvantages. For example, in the prior art type of arrangements, it has been necessary to hold the bucket in a partially opened, partially closed position during the neutral operation. As a result, the jet forces of the water issuing from the nozzle act on the bucket and tend to cause it to swing in one direction or the other. Therefore, it has been proposed to employ hydraulically actuated devices for operating the bucket. Obviously, this adds to the cost and complexity of the system.

Furthermore, certain of these devices have had to be held in a partial position to achieve the neutral operation. This requires a degree of accuracy in order to achieve the neutral condition and variations in the running of the engine, such as if the choke is activated, can cause speed differences which will result in the generation of either forward or reverse thrust since the neutral position varies with the amount of thrust being generated.

It is, therefore, a principal object of this invention to provide an improved reversing arrangement for a jet propulsion unit for a watercraft.

It is a further object of this invention to provide an improved reversing and neutral thrusting arrangement for a jet propulsion marine drive.

It is yet a further object of this invention to provide a simple yet highly effective arrangement for achieving both neutral and reverse operation with jet propulsion watercraft units.

SUMMARY OF THE INVENTION

This invention is adapted to be embodied in a water-jet propulsion unit for a watercraft having a generally rearwardly facing jet discharge nozzle. A reverse thruster bucket is supported relative to the jet discharge nozzle for movement from a first position wherein the discharge from the nozzle is substantially unrestricted and a second position wherein the discharge is redirected. Means are provided for changing the effective configuration of the reverse thrust bucket when in the second position from a first condition wherein the discharge is directed generally forwardly for achieving a reverse thrust and a second condition where neither forward nor reverse is generated.

DETAILED DESCRIPTION OF THE PREFERRED EMBODIMENTS

Figure 1:
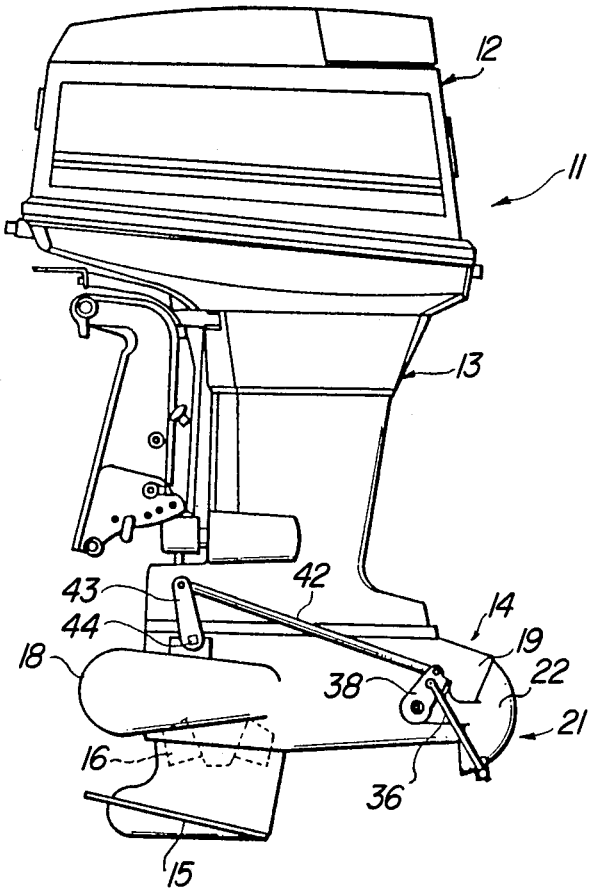
FIG. 1 is a side elevational view of an outboard motor embodying a jet propulsion unit and shifting arrangement constructed in accordance with a first embodiment of the invention.

Referring first to FIG. 1, an outboard motor constructed in accordance with a first embodiment of the invention is identified generally by the reference numeral 11. The outboard motor 11 is comprised of a power head 12 that contains a powering internal combustion engine. A drive shaft housing 13 depends from the power head 12 and contains a drive shaft (not shown) that is driven by the engine in a known manner. At the lower end of the drive shaft housing 13 there is provided a lower unit 14 that carries a propulsion device in the form of a jet propulsion unit.

Although the jet propulsion unit per se may be of any known type, it includes a generally downwardly and partially forwardly facing water inlet 15 across which a screen is provided. Water flows past the inlet to an impeller 16 that is driven by the drive shaft and is discharged into a volute chamber 18 wherein it is redirected for flow axially outwardly through a jet discharge nozzle 19 formed at the rear end of the lower unit 14. The nozzle 19 normally discharges in a generally horizontal rearward direction. A reverse bucket assembly, indicated generally by the reference numeral 21 and shown in most detail in FIGS. 2 through 7, is incorporated for redirecting the flow of water issuing from the discharge nozzle 19 so as to achieve either reverse or neutral condition for the associated watercraft.

Referring now primarily to these figures, the reverse bucket assembly 21 includes a bracket member 22 that has a pair of forwardly extending arms 23 and 24 that lie on opposite sides of the lower unit 14 and which are pivotally connected to it. The arm 23 has a pivotal connection to a pivot pin 25 that is affixed to one side of the lower unit 14 in any known manner. The arm 24 is provided with a stop portion 26 at its forward end which carries an anti-friction bushing 27 to provide a pivotal support with a pivot shaft 28 that is affixed to the respective side of the lower unit 14.

Figure 5:
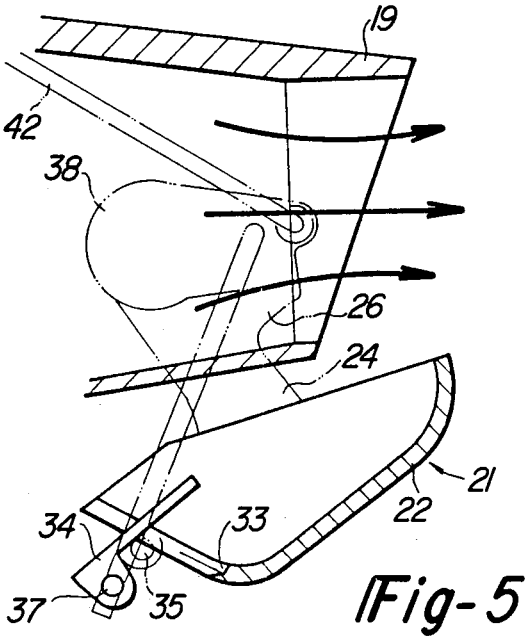
FIG. 5 is a cross-sectional view showing the mechanism in the forward drive condition.

The reverse bucket 22 is pivotal between a normal, forward operating position as shown in FIG. 5 and a closed reverse thrust generating position as shown in FIGS. 1 through 4 and 7. In the closed position, a forwardly facing inner surface 29 of the reverse thrust bucket 22 faces a discharge opening 31 of the nozzle 19 so that the water jet will impinge upon the surface 29 and be redirected by it. In reverse operation, this redirection causes the water to be issued in a forward direction through a forwardly facing opening 32 that is defined by the reverse bucket 22, in a manner to be described.

With conventional reverse bucket arrangements, the bucket only comprises the rear wall 29 and the reversely extending flow directing opening 32. In accordance with this invention, however, there is an arrangement incorporated for changing the configuration of the discharge side of the reverse bucket 22 in order to achieve either neutral or reverse drive operation when the reverse bucket 22 in is the position of closure over the discharge nozzle opening 31.

Figure 2:
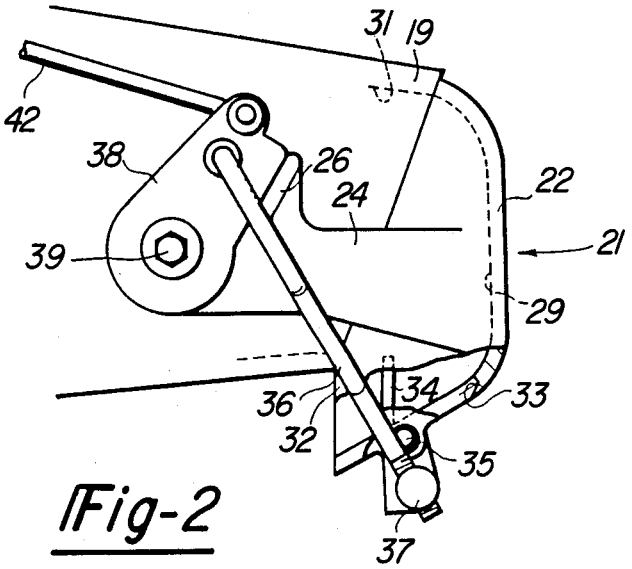
FIG. 2 is an enlarged side elevational view showing the thrust reversing mechanism.
Figure 3:
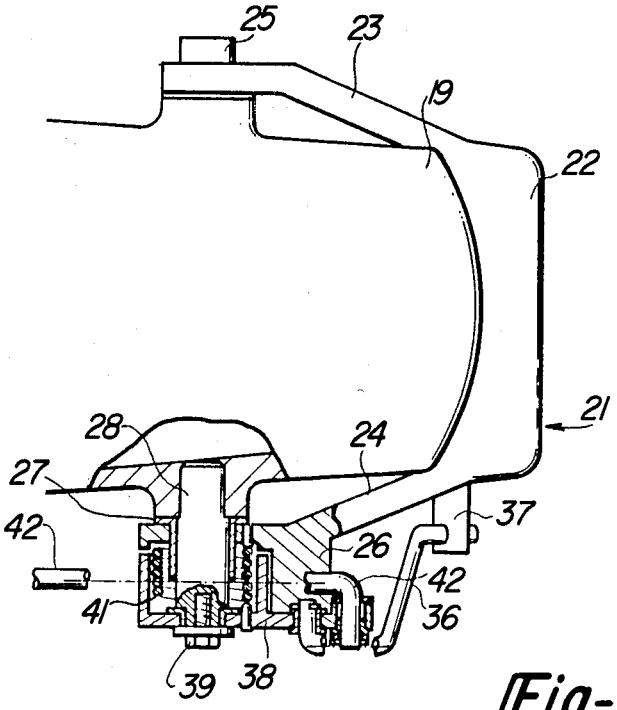
FIG. 3 is a top plan view, with a portion broken away, of the construction as shown in FIG. 2.
Figure 4:
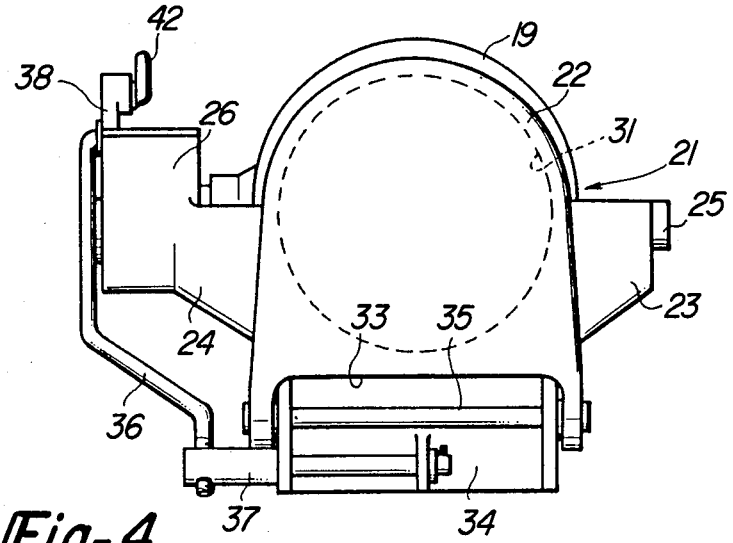
FIG. 4 is a rear elevational view of the mechanism.
Figure 6:
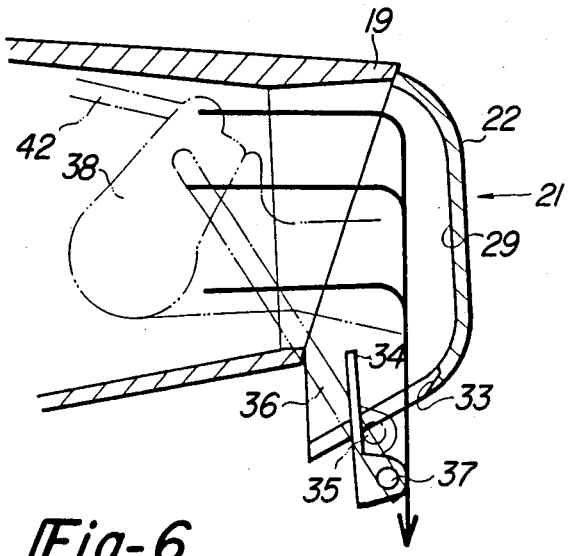
FIG. 6 is a cross-sectional view, in part similar to FIG. 5, and shows the device in the neutral condition.

To achieve this end, the lower portion of the reverse bucket below the rear wall 29 is formed with an opening 33. A closure plate 34 is pivotally supported at the lower end of the bucket 22 by means of a pivot pin 35. The closure plate 34 is pivotal between a closed, reverse thrust position (FIG. 7) and an open, neutral thrust position (FIGS. 2 and 6). A linkage system is incorporated for shifting the reverse bucket 22 and closure plate 34 in a sequence from a forward thrust position through a neutral thrust position to a reverse thrust position and vice versa so that the shifting will be in a conventional pattern and afford the operator ease of operation.

This shift linkage system is comprised of a first link 36 that has an adjustable threaded connection at one end to a bushing 37 that is pivotally connected to the closure plate 36 at one side thereof. The opposite end of the link 36 is pivotally connected to a lever 38. The lever 38 is, in turn, pivotally supported on the pivot shaft 28 coincident with the pivotal axis of the reverse bucket 22. A threaded fastener 39 holds the lever 38 in position on the pivot shaft 28.

A torsional spring 41 encircles a portion of the pivot shaft 28 and has one of its ends staked to the lever 38. The opposite end is staked to the arm 24 of the bucket 22 so as to provide a yieldable connection between the lever 38 and the bucket 22. The spring 41 normally urges the stop portion 26 of the arm 24 into engagement with the lever 38 so these elements rotate in unison. However, when the bucket 22 is in its fully closed position, the lever 38 may move relative to the bucket 22 about the pivot shaft 28 for a reason to be described.

An actuating link 42 has one of its ends pivotally connected to the lever 38. The opposite end of the actuating link 42 is connected to a forwardly disposed lever 43 that is mounted on the lower unit 14 for pivotal movement by means of a pivot pin 44. The pivot pin 44 may be actuated by means of an operator controlled shifting mechanism (not shown) so as to pivot the lever 43 and activate the reverse bucket assembly 21 in the manner now to be described.

FIG. 5 shows the condition of the reverse bucket assembly 21 when operating in forward thrust condition. Under this circumstance, the lever 38 has been rotated in a clockwise direction by clockwise rotation of the lever 43 and rearward movement of the link 42. As such, the bucket assembly 21 is positioned as shown in FIG. 2 wherein the bucket 22 is free of the discharge nozzle 19 and the water from it may flow as shown in the solid arrows in this figure. It should also be noted that in this condition, the plate 34 is held pivoted about the pin 35 in an opened position so that the opening 33 is relatively unobstructed.

If it is desired to shift to reverse condition, the lever 43 is rotated in a counterclockwise direction so as to pull the link 42 forwardly. This rotates the link 38 in a counterclockwise direction and puts a tension on the link 36 that effects movement of the bucket 22 in a counterclockwise direction about the pivot shaft 28. It should be noted that the pivot pin 37 is in an overcenter relationship to the pivot pin 35 of the plate 34 so that during this movement, the plate 34 is held in its opened position. The torsional spring 41 also acts to cause the bucket 22 to pivot in the counterclockwise direction until it moves into a closed position over the discharge nozzle 19 as shown in FIG. 6.

Referring specifically to FIG. 6, it will be noted that the closure plate 34 is still held in an opened position and hence the water issuing from the discharge nozzle 19 will be deflected downwardly by the bucket rear wall 29 and pass out the opening 33 in a generally vertical direction. As a result, the outboard drive will now be operating in a neutral condition.

If the operator continues to pivot the lever 43 in a counterclockwise direction and exert a tension force on the link 42, the lever 38 will continue to rotate in a counterclockwise direction. However, the bucket 22 is now fully closed and it will be precluded from further movement by its contact with the discharge nozzle 19. As a result, the torsional spring 41 will yield but the lever 38 will continue to rotate and exert a force on the link 36 that acts through the pivot pin 37 on the closure plate 34. The closure plate 34 will then be pivoted about its pivotal support 35 to a closed position across the opening 33 (FIG. 7).

Figure 7:
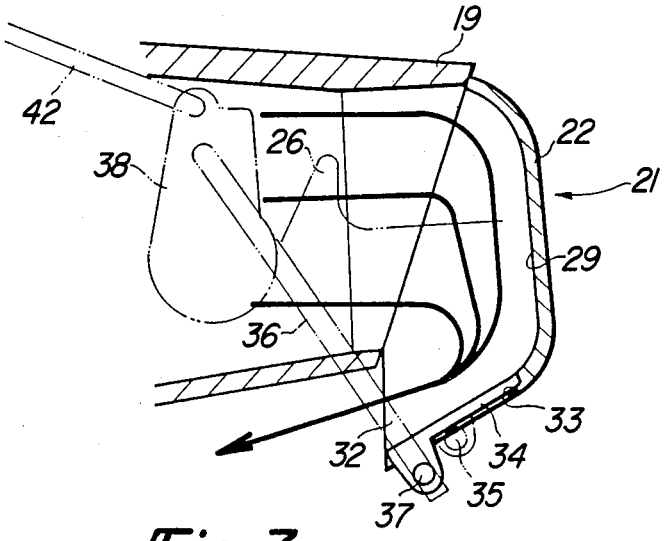
FIG. 7 is a cross-sectional view, in part similar to FIGS. 5 and 6, showing the device in a reverse condition.

As seen in FIG. 7, when the plate 34 is closed, the configuration of the discharge end of the bucket 22 will be changed so that the forwardly facing opening 32 now forms the water discharge. As a result, a reverse thrust will be generated and the watercraft will be operated in reverse.

Shifting from reverse back to forward drive occurs in the opposite direction. Under this condition, the link 42 is urged rearwardly so as to pivot the lever 38 in a clockwise direction. The initial movement will cause the closure plate 34 to pivot from its closed, reverse condition, to its open, neutral condition (FIG. 6). Continued movement will cause the bucket 22 to be moved to its open, forward thrust position as shown in FIG. 5 and as should be readily apparent to those skilled in the art.

Figure 8:
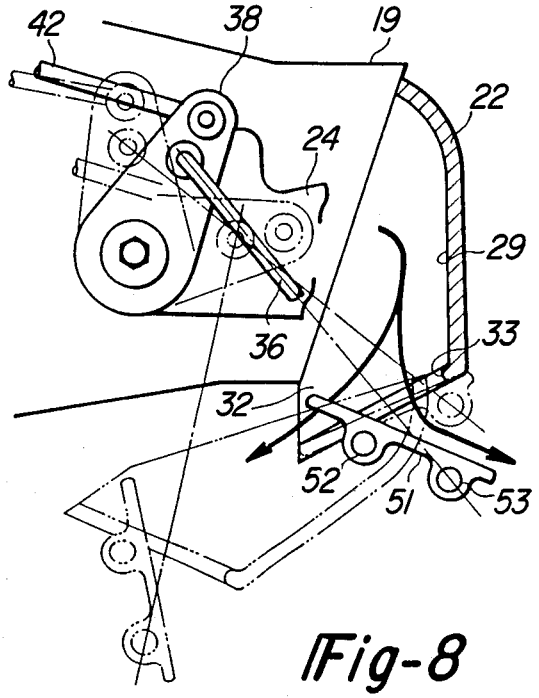
FIG. 8 is a side elevational view, in part similar to FIGS. 2, 5, 6 and 7, with portions shown in section, showing another embodiment of the invention in three alternative positions (forward, neutral and reverse).
Figure 9:
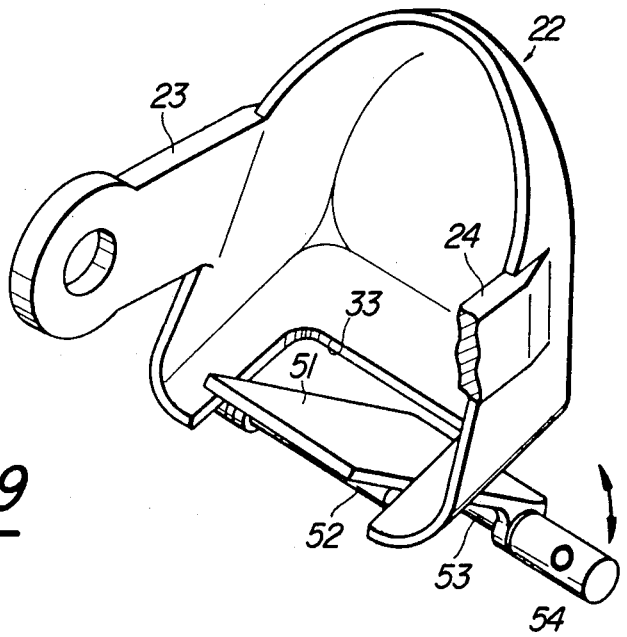
FIG. 9 is a perspective view of a thrust reversing bucket constructed in accordance with the second embodiment of the invention.

FIGS. 8 and 9 show another embodiment of the invention which is generally similar to the embodiment of FIGS. 1 through 7. The only difference in this embodiment is the manner in which the discharge opening configuration of the reverse bucket assembly 21 for neutral operation is achieved. For that reason, components of this embodiment which are the same as those of the previously described embodiment have been identified by the same reference numerals and will be described again in detail only insofar as is necessary to understand the construction and operation of this embodiment.

In this embodiment, a plate 51 cooperates with the opening 33 to vary the configuration of the discharge side of the bucket 22 for achieving either reverse or neutral operation. The plate 51 is pivotally supported relative to the bucket 22 on a pivot shaft 52. In addition, there is provided a further pivot shaft 53 to the rear side of the pivot shaft 56 upon which a connection 54 is journaled. The connection 54 accommodates the threaded and adjustable connection to the link 36 so that the link 36 can operate the plate 51.

As shown in the solid line view of FIG. 8, when the mechanism is in its neutral condition, the plate 51 is disposed so that the opening 33 is partially opened and the opening 32 is also partially opened. As a result, the forward and rearward flow of water will be balanced and the outboard drive will operate in a neutral condition. When the plate 51 is closed, the mechanism will operate in a reverse mode as aforedescribed. Therefore, it is believed from the foregoing description that the operation of this embodiment is obvious to those skilled in the art.

It should be readily apparent from the foregoing description that two embodiments of the invention have been illustrated and described each of which permits easy and effective shifting between forward and reverse with a neutral intermediate position. In all cases, the shifting is accomplished without necessitating the operator overcoming large water forces acting against the movement of the shifting mechanism and hence power assist is unnecessary. In addition, the neutral position is a fixed position and does not depend upon operator skill in maintaining the device in a balanced position. Although two embodiments of the invention have been illustrated and described, various changes and modifications may be made without departing from the spirit and scope of the invention, as defined by the appended claims.

I claim:

1. A water-jet propulsion unit for a watercraft having a generally rearwardly facing jet discharge nozzle, a reverse thrust bucket movably supported relative to said jet discharge nozzle from a first position wherein the discharge from said nozzle is substantially unrestricted and a second position wherein said reverse bucket defines an outlet for redirecting said discharge, and means for changing the effective configuration of said reverse thrust bucket outlet when in said second position from a first condition wherein said discharge is directed forwardly for effecting a reverse thrust and in a second condition wherein a neutral thrust is generated comprising a second member supported by said reverse thrust bucket for movement relative thereto for changing the configuration of said reverse thrust bucket outlet.

2. A water-jet propulsion unit as set forth in claim 1 wherein linkage means is effective for shifting the discharge bucket between a forward thrust condition, a neutral thrust condition and a reverse thrust condition in that order.

3. A water-jet propulsion unit as set forth in claim 1 wherein the second member is pivotally supported by the reverse thrust bucket.

4. A water-jet propulsion unit as set forth in claim 3 wherein the reverse thrust bucket has a first portion that is adapted to extend across the jet discharge nozzle when said reverse thrust bucket is in its second position and the outlet is formed at one end of said first portion, said second member being effective to control the configuration of said outlet.

5. A water-jet propulsion unit as set forth in claim 4 wherein the second member is pivotal between a first position wherein the water jet is directed downwardly and a second position wherein the water jet is directed forwardly.

6. A water-jet propulsion unit for a watercraft having a generally rearwardly facing jet discharge nozzle, a reverse thrust bucket movably supported relative to said jet discharge nozzle from a first position wherein the discharge from said nozzle is substantially unrestricted and a second position wherein said discharge is redirected, said reverse thrust bucket having a first portion adapted to extend across said jet discharge nozzle when said reverse thrust bucket is in said second position and an opening formed at one end of said first portion, and a second member pivotally supported relative to said reverse thrust bucket for changing the effective configuration of said reverse thrust bucket opening when in said second position from a first position wherein the water jet discharge is directed forwardly and rearwardly in equal amounts for generating a neutral thrust and a second position wherein the water jet discharge is directed forwardly for generating a reverse thrust.

* * * * *